US006895722B1

(12) United States Patent
Ponder

(10) Patent No.: US 6,895,722 B1
(45) Date of Patent: May 24, 2005

(54) FOLDING STRUCTURAL PANEL UNIT

(75) Inventor: Sanford Ponder, Redmond, WA (US)

(73) Assignee: Icosa Village, Inc., Redmond, WA (US)

( * ) Notice: Subject to any disclaimer, the term of this patent is extended or adjusted under 35 U.S.C. 154(b) by 0 days.

(21) Appl. No.: 10/218,302

(22) Filed: Aug. 13, 2002

Related U.S. Application Data

(60) Provisional application No. 60/313,984, filed on Aug. 20, 2001.

(51) Int. Cl.[7] ..... E04C 2/00; E04C 2/32

(52) U.S. Cl. ..... 52/578; 52/782.1; 52/796.1; 52/798.1; 52/64; 52/70; 52/506.01; 52/518; 52/569; 52/79.1; 52/27

(58) Field of Search ..... 52/64, 70, 408–409, 52/455–456, 506.01, 506.06, 518, 561, 569–572, 52/578, 782.1, 796.1, 798.1, 799.1, 79.1, 52/79.5, 79.9, 27, 36.1; 446/85, 86, 108, 446/109, 111–116, 121, 122, 487, 488

(56) References Cited

U.S. PATENT DOCUMENTS

| | | | | |
|---|---|---|---|---|
| 2,881,717 A | | 4/1959 | Fuller | |
| 3,660,952 A | | 5/1972 | Wilson | 52/81 |
| 3,798,852 A | * | 3/1974 | Nicoll, Jr. | 52/90 |
| 3,883,999 A | * | 5/1975 | Nicoll, Jr. | 52/90 |
| 3,887,952 A | * | 6/1975 | Nicoll, Jr. | 9/6 |
| 3,894,354 A | * | 7/1975 | Crawley | 46/16 |
| 4,945,693 A | | 8/1990 | Cooley | 52/81 |
| 5,281,185 A | * | 1/1994 | Lee | 446/85 |
| 5,836,254 A | * | 11/1998 | Johansson | 108/51.3 |

* cited by examiner

*Primary Examiner*—Jeanette Chapman
(74) *Attorney, Agent, or Firm*—Jacques M. Dulin, Esq.; Innovation Law Group, Ltd.

(57) ABSTRACT

Lightweight structural panel units for construction of space enclosing structures each of which is formed from a blank of flat, suitably rigid, yet foldable sheet of material, which are profiled and pre-creased with a unique configuration. Upon folding, the blanks form a substantially hollow three dimensional polygonal beam-like unit having a shape and configuration which positively aligns and interlocks when conjoined with a plurality of similar folded beam-like units to form a substantially hollow 3-dimensional "structural panel unit" having symmetrical cross bracing inside and sufficient rigidity to enable sufficiently large areas to be produced for the construction of space enclosing structures. Each structural panel unit has a configuration and profile that positively aligns and interlocks when engaged with similar structural panel units to complete a desired space-enclosing structure which has an exterior facing surface and an interior facing surface separated by a substantially hollow void.

28 Claims, 17 Drawing Sheets

FOLDING STRUCTURAL PANEL UNIT

CROSS REFERENCE TO RELATED APPLICATION

Figure 1A:
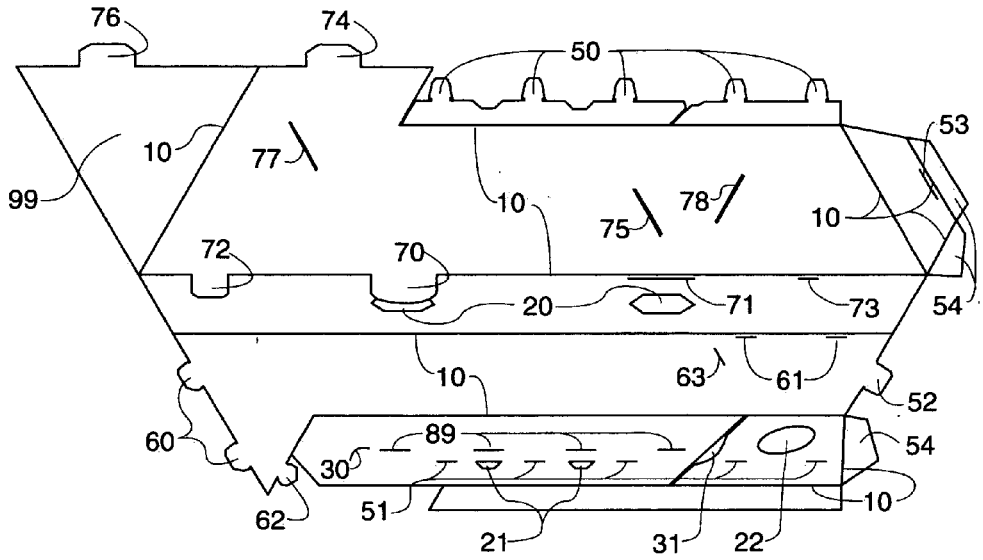

This application claims the benefit of Provisional Patent Application Ser. No. 60/313,984 filed 2001, Aug. 20.

FEDERALLY SPONSORED RESEARCH

Not Applicable

SEQUENCE LISTING OR PROGRAM

Not applicable

BACKGROUND

My invention relates to a method for constructing lightweight structural panel units suitable for use in constructing space enclosing structures.

Building construction members, particularly triangular shaped structural panels utilized in the construction of geodesic, or dome like space enclosing structures are known.

The most common means for constructing such structural panels will generally consist of some type of space framework composed of wood or metal struts and various attachment hardware combined to produce a polygonal form unit, usually triangular in shape, which will then have a covering material of some type, or structural panels which are fabricated from a formed, or molded and then hardened matter or composite material.

The manufacturing process for the common types of structural panels is frequently complicated, time-consuming and costly, and the resulting structural panels are not generally portable, or easily assembled into larger space enclosing structures without specialized machinery, skilled labor, and tools.

U.S. Pat. No. 2,881,717, Buckminster Fuller—entitled "Building Construction", discloses a method of folding cardboard or other flat sheet material to form a "building member" suitable for constructing geodesic dome structure.

The benefits achieved by utilizing folded, flat sheets of material to fabricate structural panel units are many, and include: lower cost of materials, lower cost of fabrication, lighter weight, and easier onsite assembly relative to most common means for fabricating structural panels.

Beyond early experimental work in the 1950's and 1960's with folding cardboard geodesic domes, Fuller's approach has failed to find any significant commercial application due to a variety of weaknesses in the method.

In the prior art, the approach was to take a single flat sheet of relatively heavy material and fold it into itself to form a relatively small structural panel. A panel so formed had no integrated means for allowing itself to be attached or conjoined to additional, like panels during the construction of a space enclosing structure. That approach also severely limited the scale and utility of the structural panel so formed, and made the construction of space enclosing structures a complicated and tedious process prone to errors in panel alignment.

Prior art examples have also generally had no integrated provision for allowing natural light to pass into the space enclosing structure formed from such structural panels, unless the panels were only intended to produce a space frame, wherein such a space frame had no utility as a weather proof shelter without additional material or parts.

Objects and Advantages

The current invention asserts significant and unique improvements over, and differs substantially from the prior art, in the number of, and manner in which, flat sheets of material are profiled, folded, and conjoined to form a structural panel, and further how said structural panels are conjoined to form a space enclosing structure.

The current invention utilizes a plurality of similarly profiled flat sheets of material which are folded and conjoined to form a single Structural Panel Unit. This approach allows very large structural panel units to be formed from standard material blanks which have been produced with standard fabrication equipment.

Additionally, the folding method presently described, provides a significant amount of symmetrical cross bracing within a formed structural panel, and provides flaps or flanges without, which will serve to overlap similar adjacent structural panels being conjoined to form a space enclosing structure. This overlapping action provides a simple means for ensuring structural panel alignment and attachment, making the construction of a useful space enclosing structure far easier to accomplish than with a panel type described in the prior art.

The current invention is structurally superior to, and allows the use of a much less substantial material than that required in the prior art while still providing suitable strength for the construction of a useful space enclosing structure.

The current invention provides a method for constructing space enclosing structures wherein all parts may be fabricated on standard flat material conversion equipment available worldwide, be produced from readily available commodity materials, and wherein said space enclosing structures may be constructed and utilized by unskilled labor following simple pictographic instructions.

Objectives (1)—To define and establish a unique method for making structural panel units suitable for use in constructing space enclosing structures.

(2)—To provide a panelized structural sub-assembly which employs an integrated structural skin approach with cooperating integrated internal bracing, which utilizes both tension and compression force, and which allows structural load to be distributed evenly making additional framing material unnecessary in the forming of a greater space enclosing structure.

(3)—To provide a structural panel unit which has an overlapping configuration when conjoined with similar such structural panels, and wherein said conjoined structural panel units are automatically forced to behave structurally together in unison eliminating the possibility of misalignment in all directions—toward the center, away from the center, and along the surface.

(4)—To provide a substantially hollow structural panel unit, wherein a plurality of said panel units are utilized to form a space enclosing structure having an effective concentric shell configuration, wherein said shell configuration encloses a substantially hollow void between an outer facing and an inner facing shell surface, and whereby airflow may pass in between said surfaces freely moving in all directions which run in parallel to said surfaces by convective or other means.

(3)—To provide a structural panel unit which possesses remarkable strength relative to its composite material mass.

(2)—To utilize a commonly available method for profiling blank, flat sheet material, which allows for simple and inexpensive part production.

(9)—To provide a structural panel unit configuration which facilitates convenient final onsite assembly.

(11)—To provide a structural panel unit wherein useful accessories, or structural details such as a doorway, windows, or a ground to structure interface assembly, may be added or modified simply by utilizing the same method of folding flat sheets of material which have been profiled for engagement with said structural panels.

SUMMARY OF THE INVENTION

This invention is directed to a unique method for constructing prefabricated, self-supporting, integrated, hollow structural panel units which are made from a plurality of flat sheets of suitably rigid, foldable material, wherein said sheets of foldable material have been profiled for engagement, folded, and conjoined together to provide a structural panel unit of the desired size and rigidity required to construct a space enclosing structure.

Space enclosing structures which are resulting from the conjoining of a plurality of said structural panel units are conceived of as temporary, or semi permanent structures of nearly any size, and which are suitable for shelter or amusement.

DRAWINGS

Certain embodiments of the invention are described by way of illustration, without limitation thereto other than as set forth in the accompanying claims, reference being made to the accompanying drawings, wherein:

DRAWING FIGURES

FIG. 1A Flat view of profiled foldable sheet of material with reference numerals.

Figure 1B:
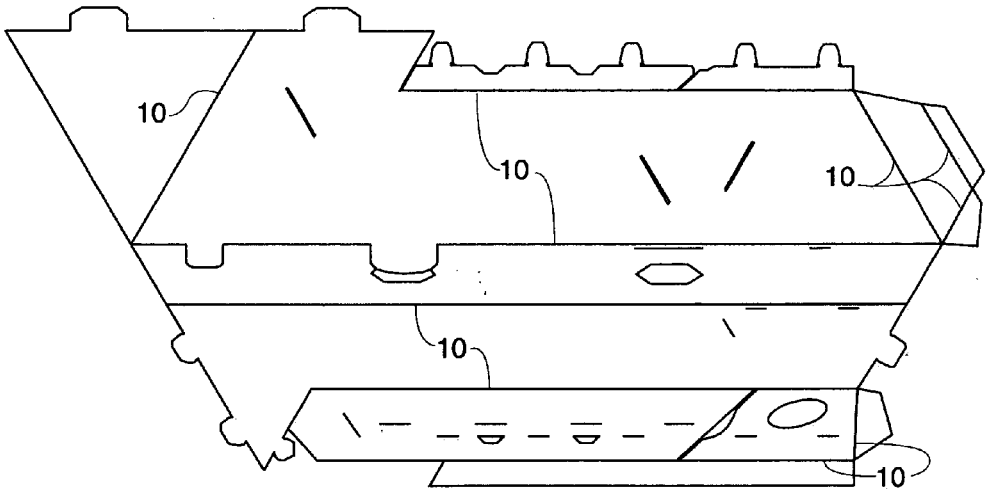

FIG. 1B Flat view of profiled foldable sheet of material.

Figure 2A:
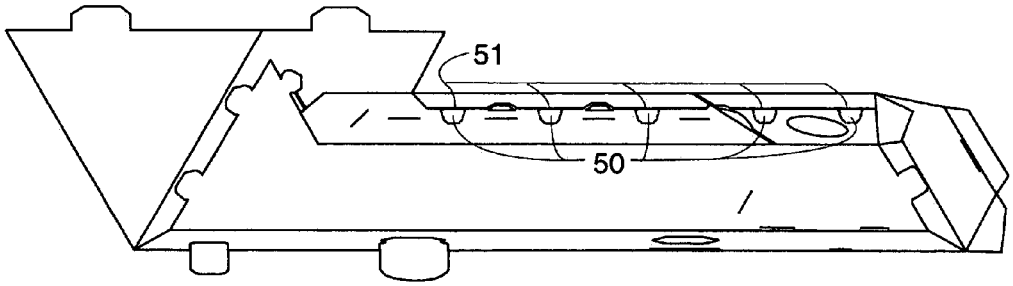
Figure 2B:
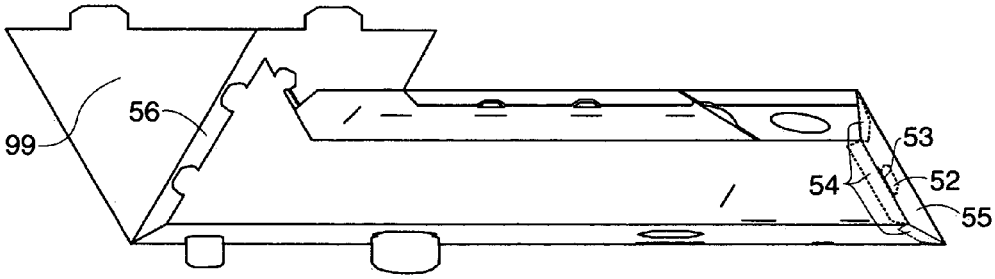
Figure 3A:
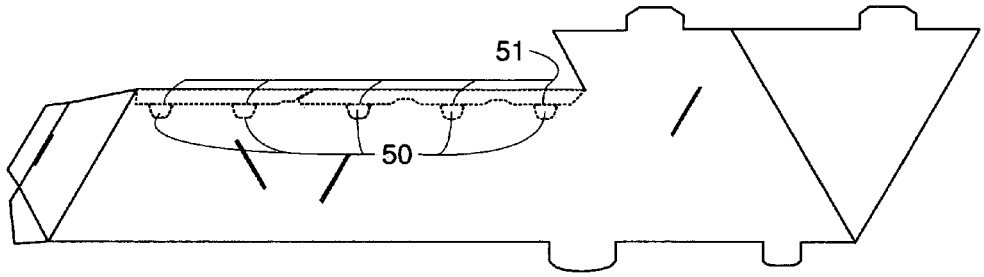
Figure 3B:
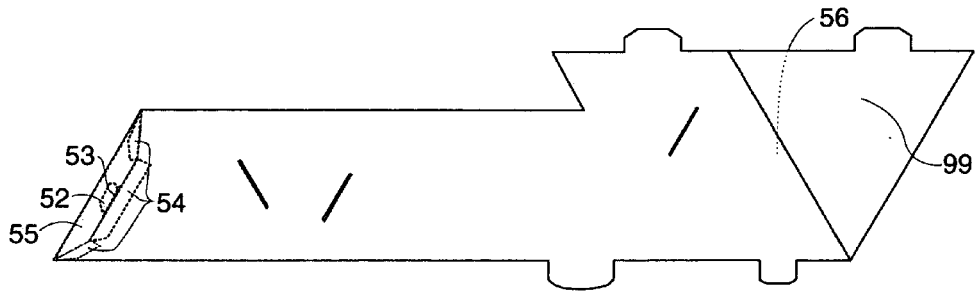
Figure 4A:
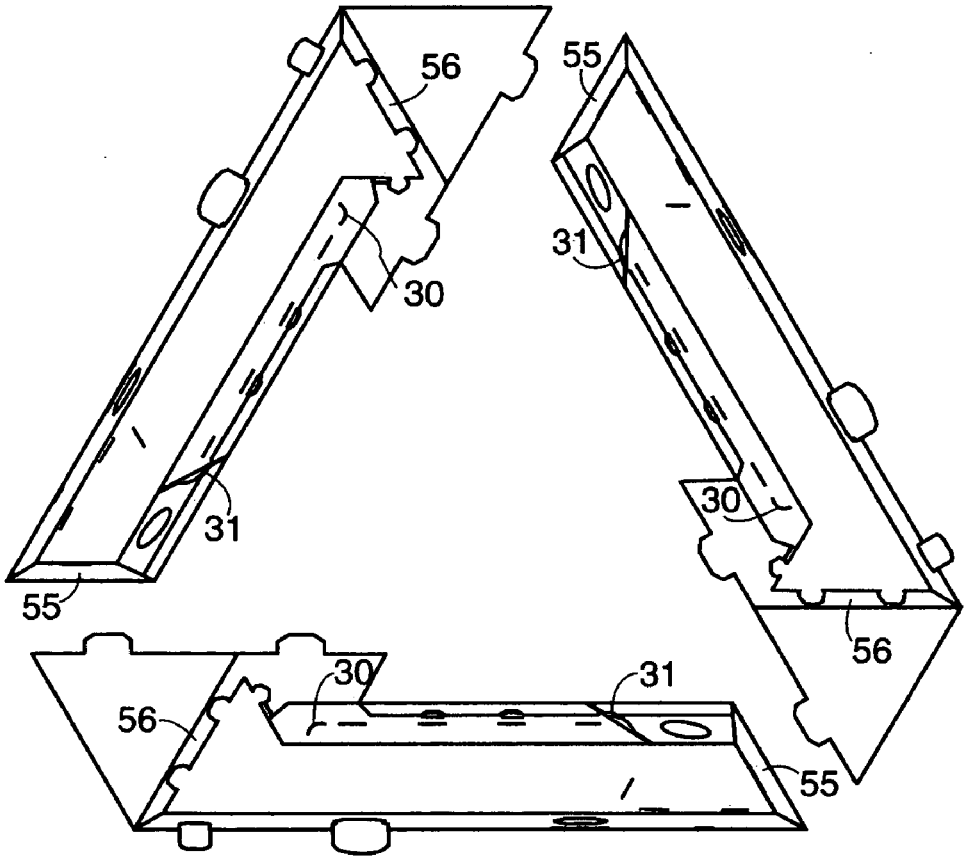
Figure 4B:
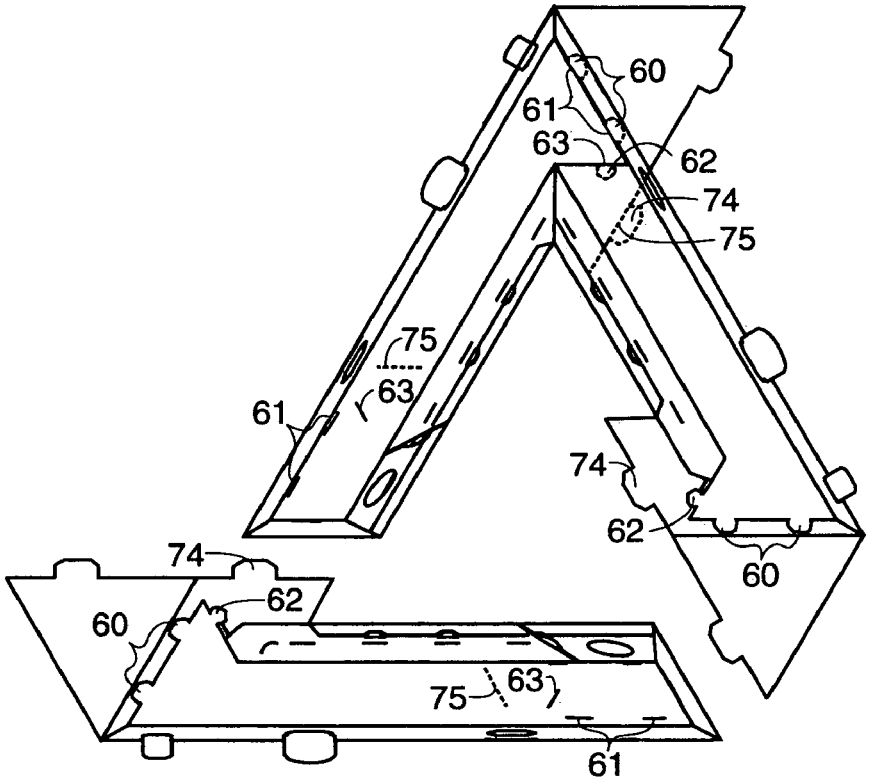
Figure 4C:
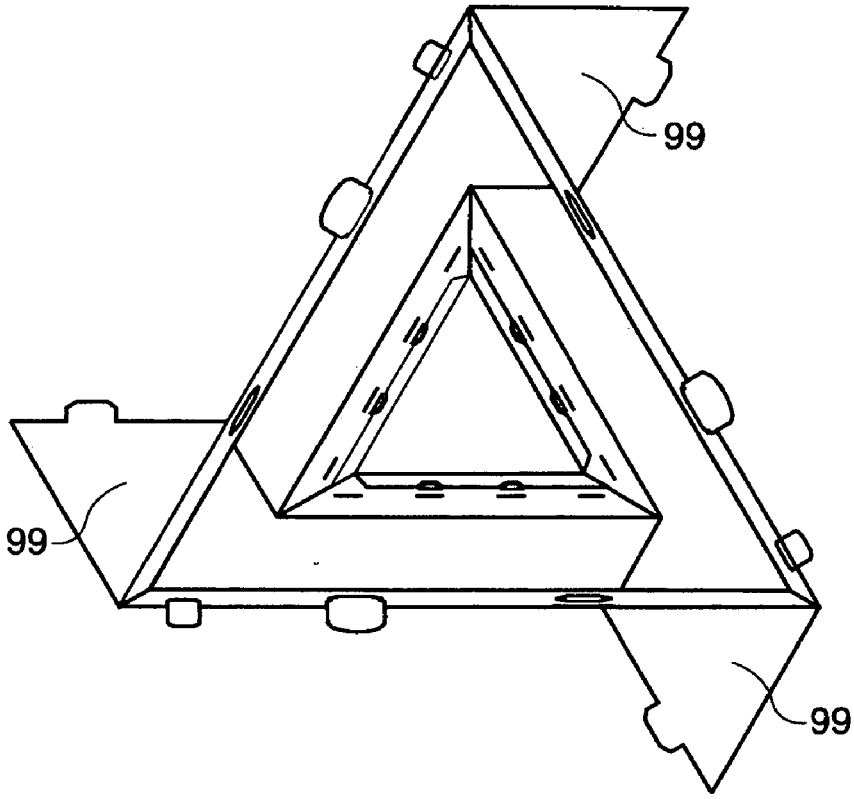
Figure 5A:
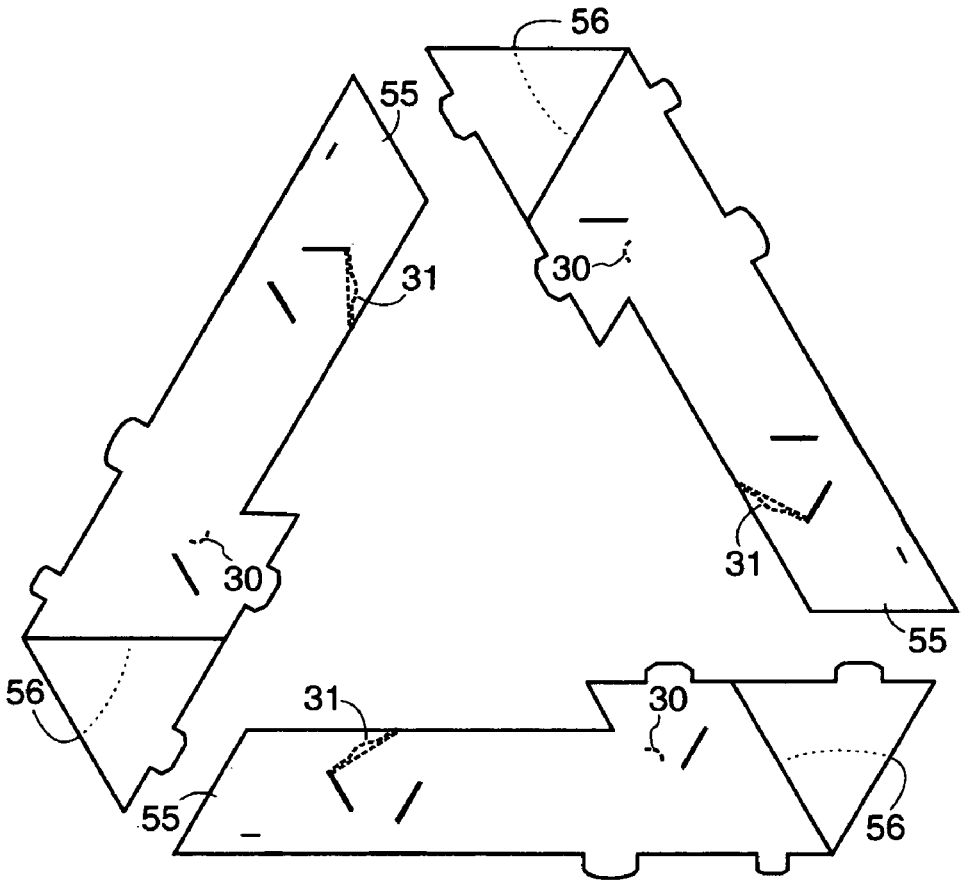
Figure 5B:
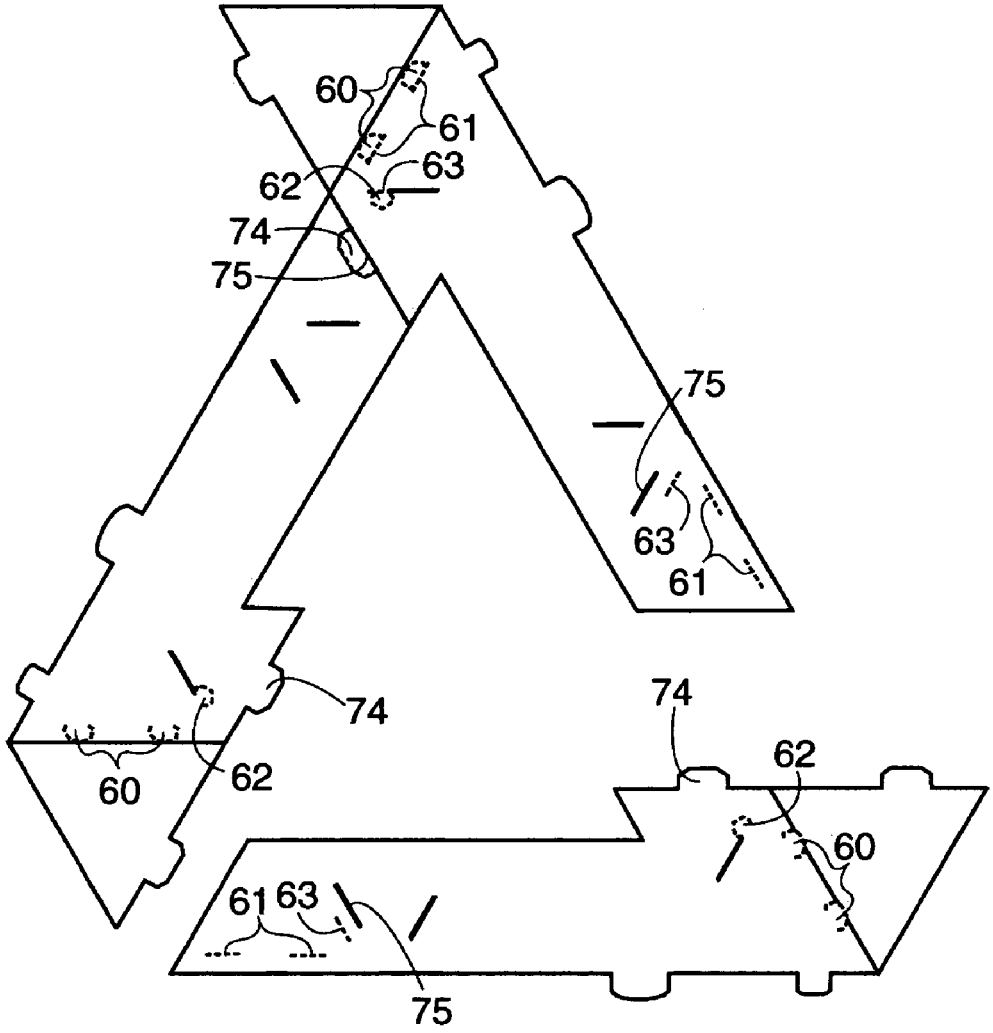
Figure 5C:
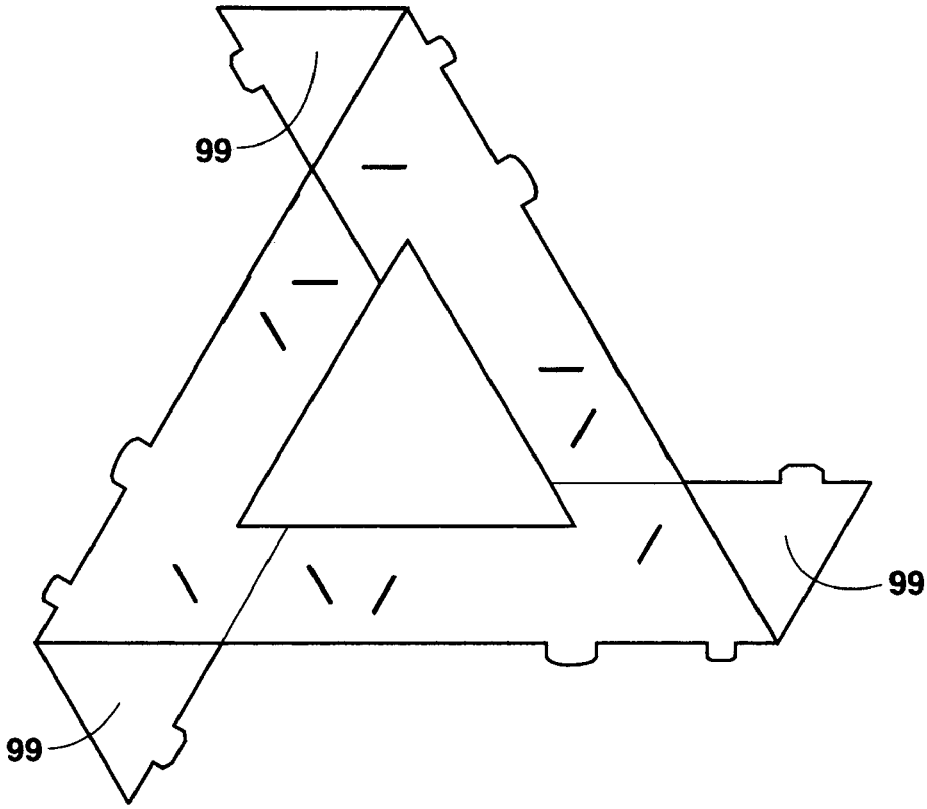
Figure 6A:
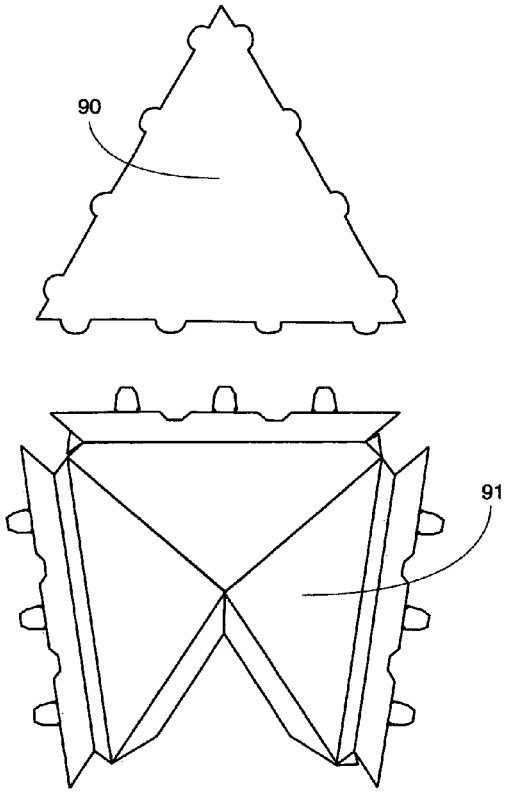
Figure 6B:
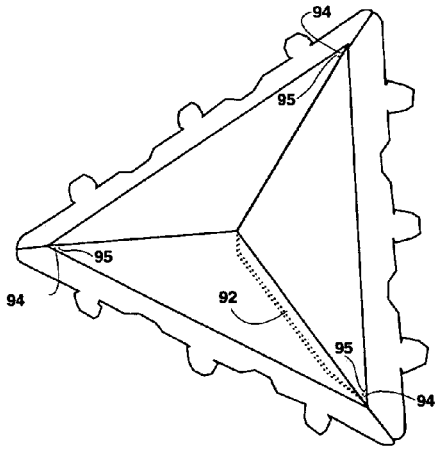
Figure 7A:
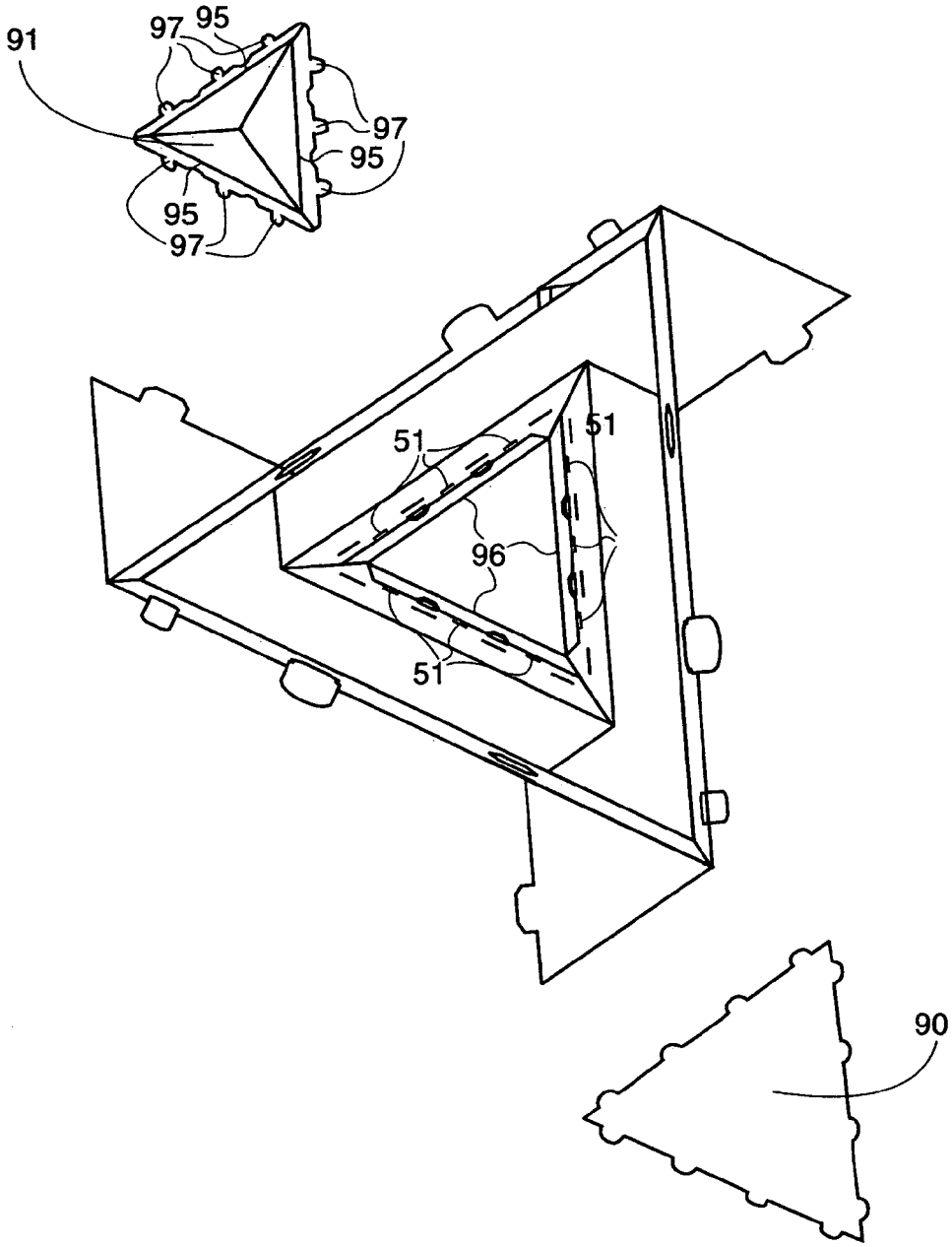
Figure 7B:
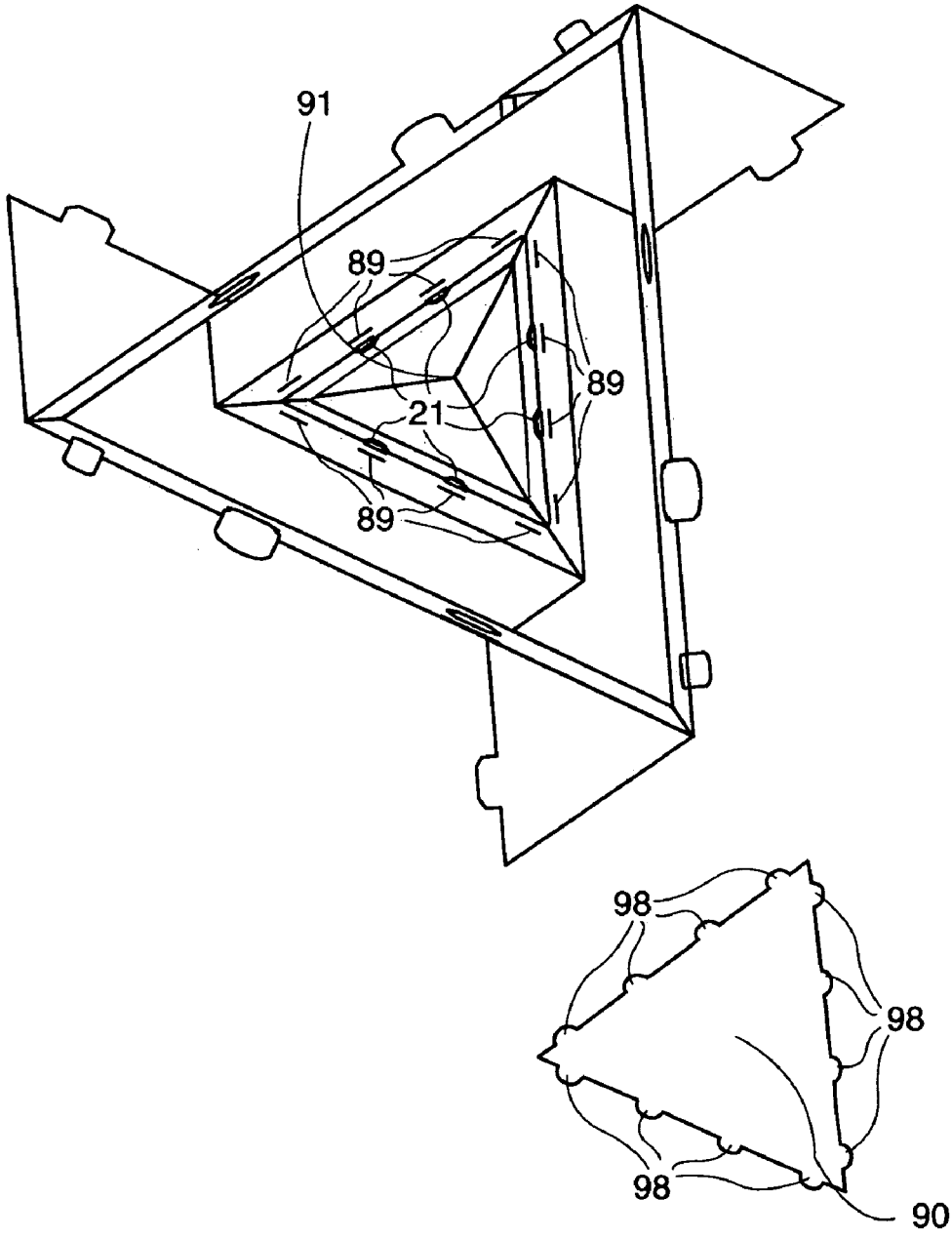
Figure 7C:
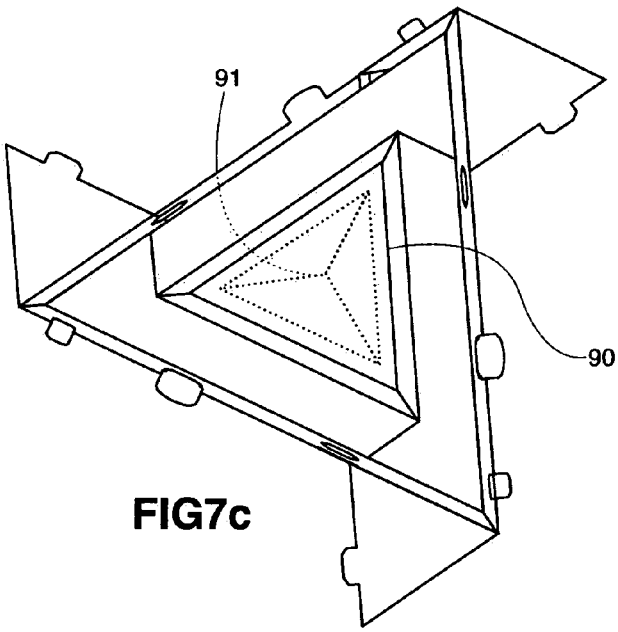
Figure 7D:
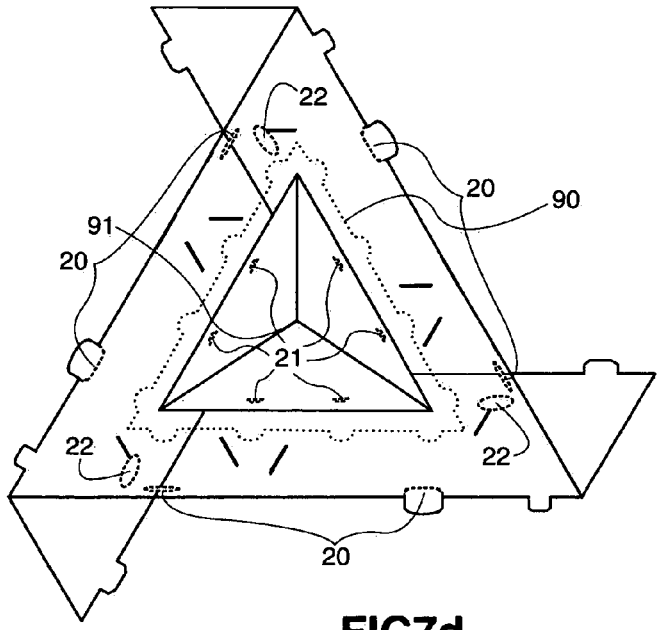
Figure 8:
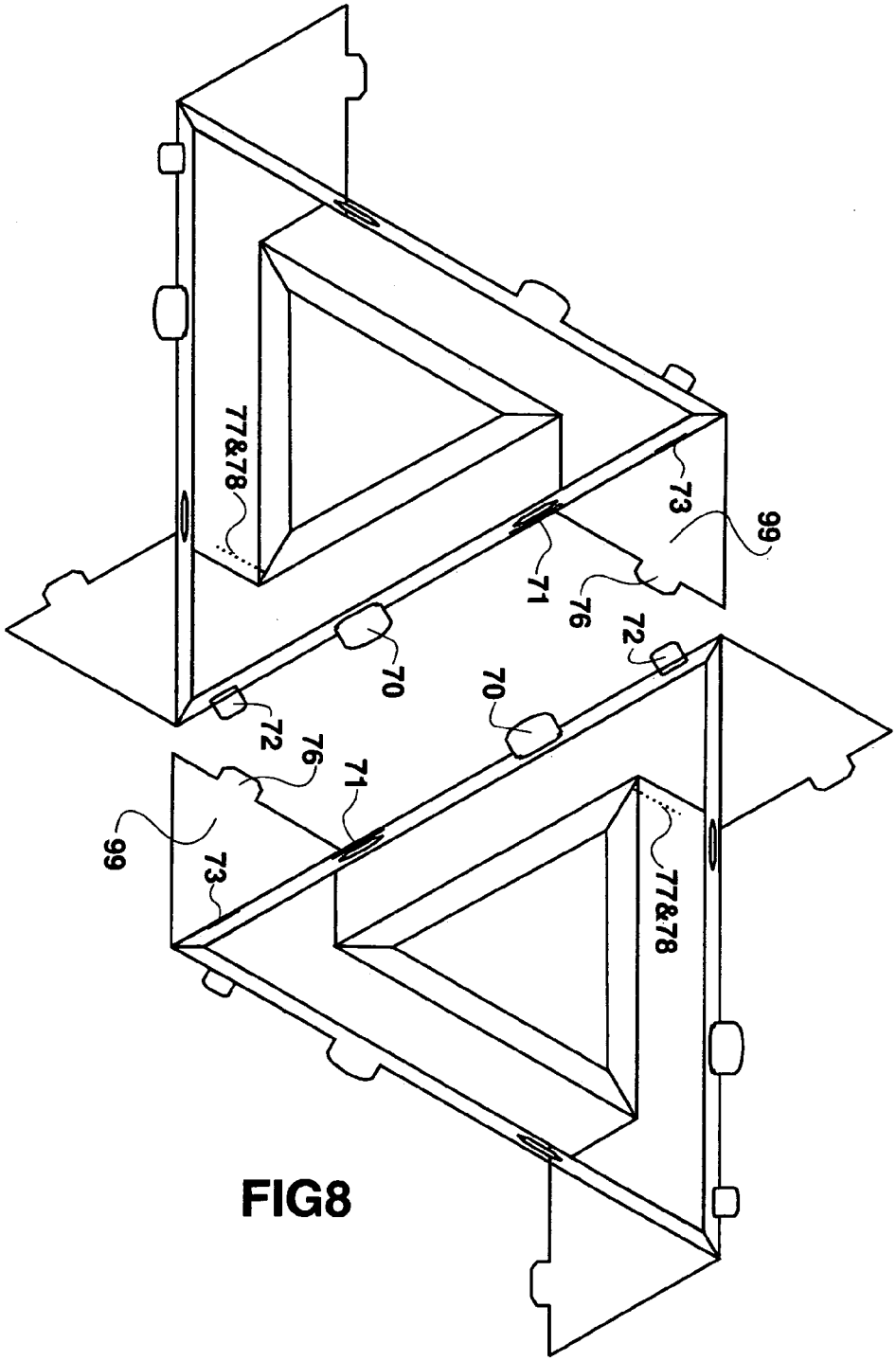
Figure 9A:
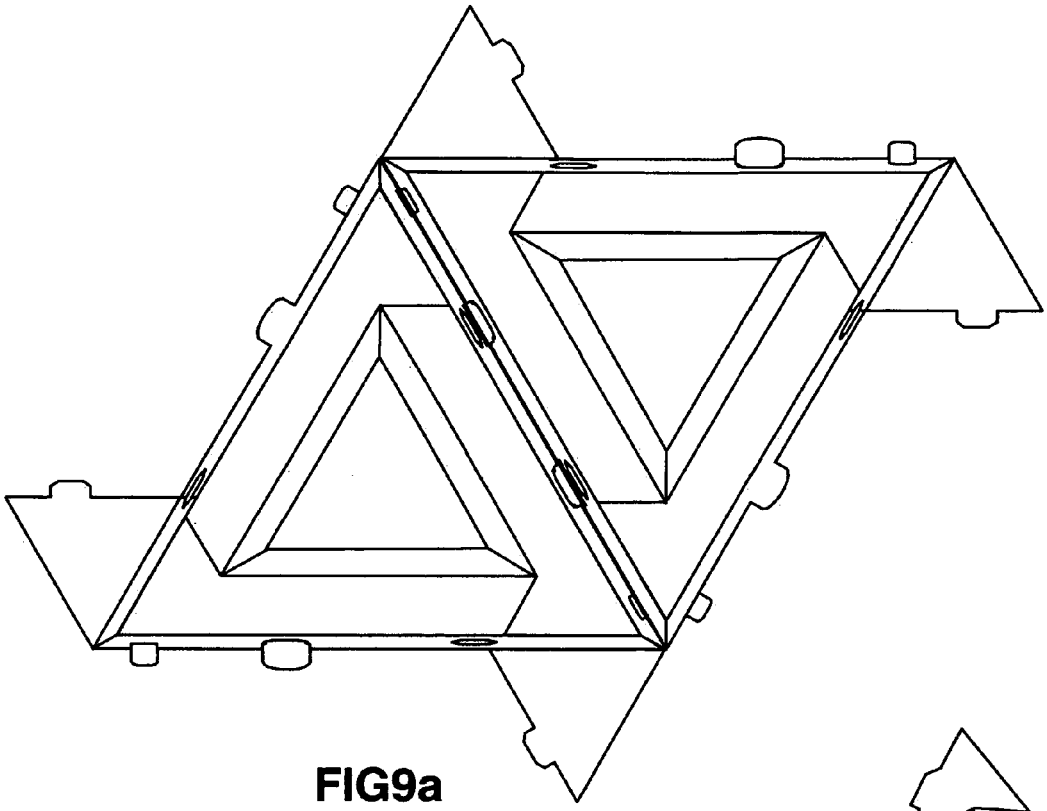
Figure 9B:
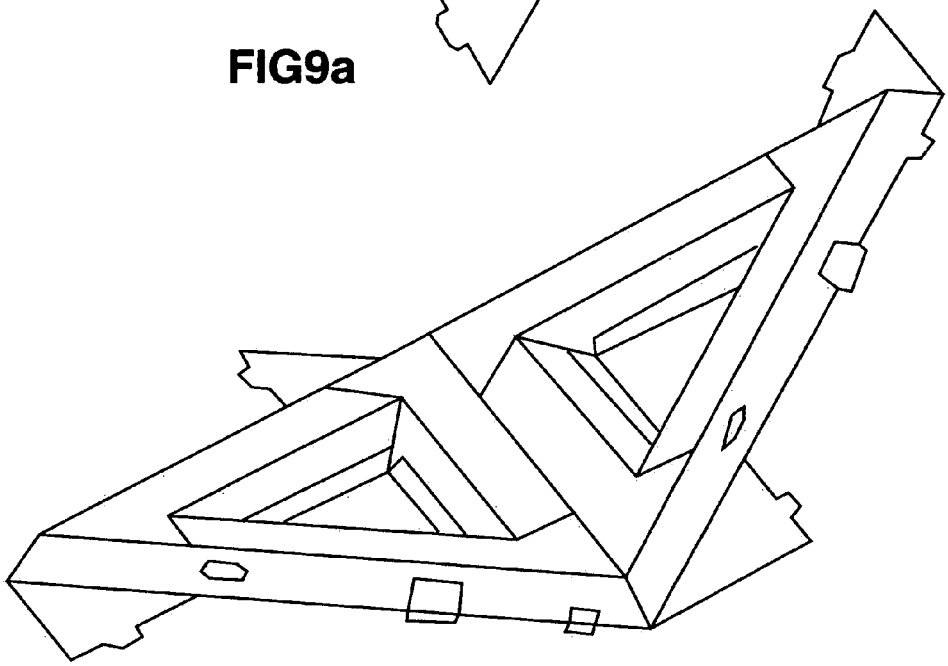
Figure 10:
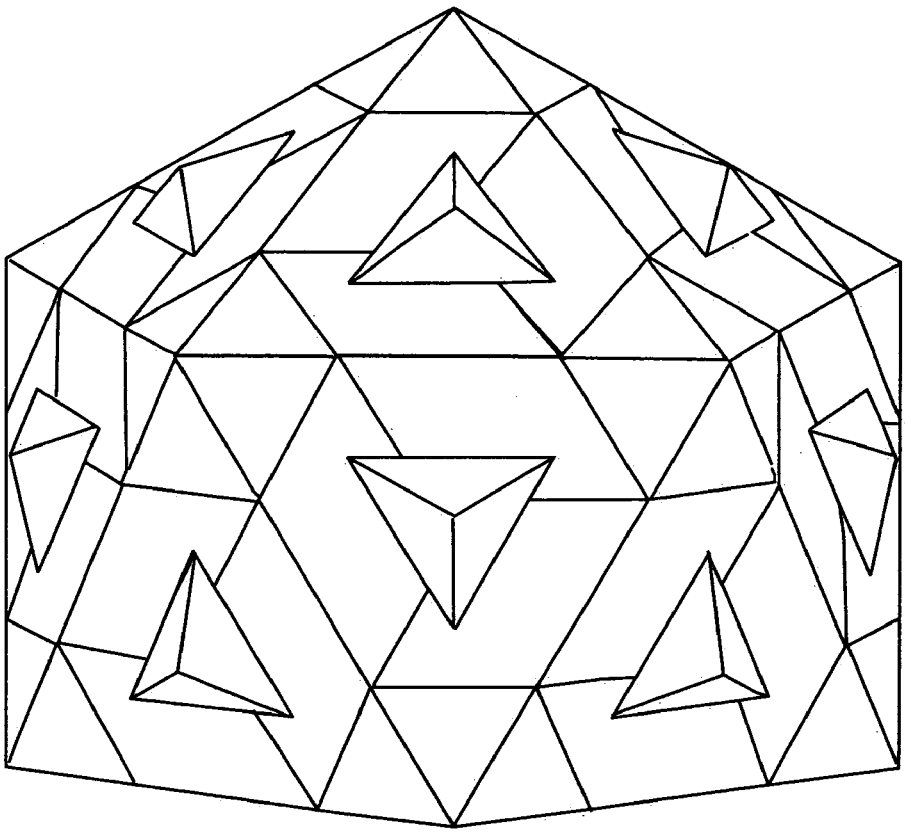
Figure 11:
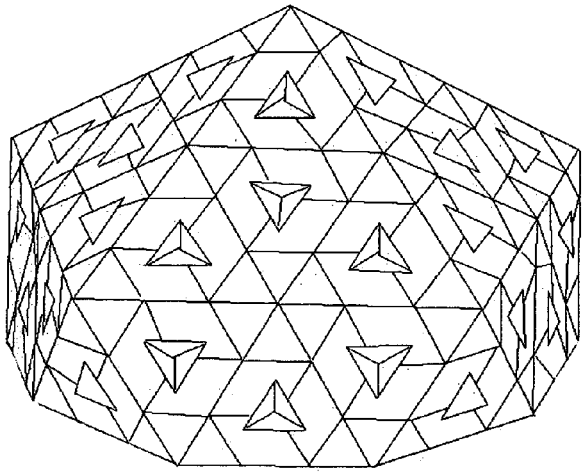
Figure 12:
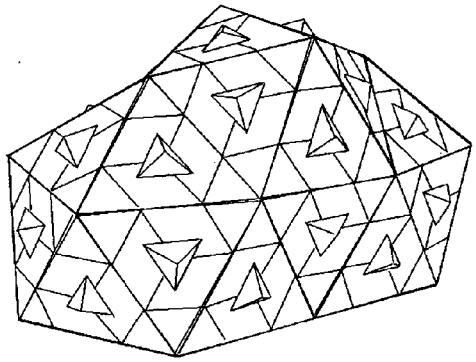
Figure 13:
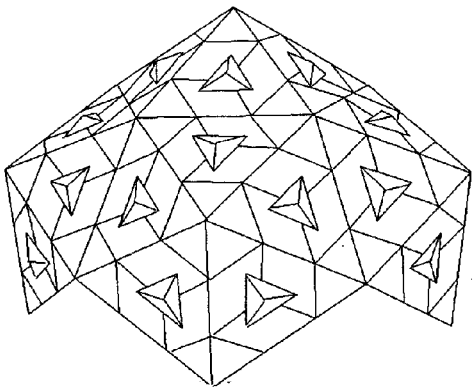

FIG. 2A Inside perspective of folded polygonal beam like unit partially complete FIG. 2B Inside perspective of folded polygonal beam like unit complete FIG. 3A Outside perspective of folded polygonal beam like unit partially complete FIG. 3B Outside perspective of folded polygonal beam like unit FIG. 4A Interior perspective of three folded polygonal beam like units FIG. 4B Shows conjoining polygonal beam like units FIG. 4C Interior perspective of a structural panel unit FIG. 5A Exterior perspective of three folded polygonal beam like units FIG. 5B Shows conjoining polygonal beam like units FIG. 5C Exterior perspective of a structural panel unit FIG. 6 Optional "window" parts FIG. 7A Interior perspective of structural panel with window parts FIG. 7B Interior perspective of structural panel with window parts partially FIG. 7C Interior perspective of a structural panel unit, window parts conjoined FIG. 7D Exterior perspective of a structural panel unit, window parts conjoined FIG. 8 Shows conjoining structural panel units FIG. 9A One configuration of 2 conjoined structural panel units FIG. 9B Another configuration of 2 conjoined structural panel units FIG. 10 Exterior perspective of a fifteen faceted, partial icosahedron FIG. 11 A space enclosing structure utilizing 40 structural panel units FIG. 12 A space enclosing structure utilizing 30 structural panel units FIG. 13 Another space enclosing structure utilizing 30 structural panel units

REFERENCE NUMERALS IN DRAWINGS

10 Crease line
20 Vent hole (edge)
21 Vent hole (window)
22 Vent hole (box end)
50 Tabs (panel beam)
51 Slots (panel beam)
52 Tab (box end)
53 Slot (box end)
54 Box end flaps
55 Closed end of beam
56 Open beam end
60 Tab (panel beam inside tri)
61 Slot a (panel beam inside tri)
62 Tab c (panel beam inside tri)
63 Slot c (panel beam inside tri)
70 Tab a (system panel unit edge)
71 Slot a (system panel unit edge)
72 Tab b(system panel unit edge)
73 Slot b(system panel unit edge)
74 Tab a (outside face)
75 Slot a (outside face)
76 Tab b (outside face)
77 Slot b (outside face)
30 Bayonet Tab
31 Slot Bayonet
89 Inner window mounting slots
90 Inner window part
91 Outer window part
92 Outer window seam flap
94 Outer window corner flap
95 Outer window v edge
96 Window opening saddle edge
97 Outer window tabs
98 Inner window tabs
99 Large triangle flange

DETAILED DESCRIPTION

One Embodiment

In the presently described embodiment, a substantially hollow, triangular shaped Structural Panel Unit (FIG. 4C, 5C) suitable for the construction of space enclosing structures is formed from the conjunction of three similar beam like units (FIG. 4A, 5A) wherein said beam like units (FIG. 2B, 3B) have been each formed by folding a flat sheet of material (FIG. 1B) and wherein a plurality of said structural panel units are conjoined to form a desired space enclosing structure (FIGS. 10 through 13).

Fold a Beam

Referring to FIG. 1A, a view of a flat, profiled sheet of material, utilized in one embodiment of the present invention is shown.

Wherein, said profiled sheet of material is to be folded along crease lines 10 (FIG. 1B), and tabs 50 mate with slots 51 (FIG. 2A), and tab 52 is inserted into slot 53 (FIG. 2B) and flaps 54 are folded so that said flaps form a closed box like end 55 (FIG. 2B), thereby forming a hollow three dimensional beam like unit (FIG. 2B) having a polygonal cross section. Adhesive means, or other mechanical fastener means may easily be substituted for the tabs and slots.

Wherein said beam is closed or boxed on one end 55, and substantially open on the opposite end 56 (FIG. 2B), wherein said closed end 55 is profiled for under-lapping and said open end 56 is profiled for overlapping.

Wherein said beam has a substantial flap 99 which extends sideways from the outside edge of the exterior facing plane of said beam (FIG. 2B).

Wherein said beam has a vent hole 22 (FIG. 7D) which will enable airflow to pass into or out of said hollow beam when said beam is conjoined with similar beams.

Note: FIGS. 2A, 2B, 2C illustrate the preceding steps from an interior facing plane view and FIGS. 3A, 3B, 3C illustrate the same steps from an exterior facing plane view.

Form a Structural Panel

Referring to FIG. 4A, an interior facing plane view showing three beam like units arranged and ready to be conjoined and interlocked to form a structural panel unit is shown.

By sliding the boxed end 55 of a first beam into the open end 56 of second similar beam, and aligning bayonet 30 of said second beam into slot 31 of said first beam, said beam units become interlocked together (FIG. 4B), wherein said interlocking action serves to align and secure said beam like units together.

Referring to FIG. 4B, said two conjoined beams are arranged for conjoining and interlocking with a third beam.

By sliding said boxed end 55 of said second beam into the open end 56 of said third beam and inserting box end 55 of said third beam into said open end of said first beam, and aligning bayonet 30 of said third beam into slot 31 of said second beam, and aligning bayonet 30 of said first beam into slot 31 of said third beam, all three said beam units become interlocked together (FIG. 4B) forming a structural panel unit (FIG. 4C) suitable for use in the construction of space enclosing structures.

Referring to FIG. 4C, an interior facing plane view of said structural panel unit wherein triangular flaps 99 extend sideways from the outside edge of the exterior facing plane of said conjoined beams forming said structural panel unit is shown.

Note: FIGS. 4A, 4B, 4C illustrate the preceding steps from an interior facing plane view and FIGS. 5A, 5B, 5C illustrate the same steps from an exterior facing plane view.

Window Parts

In the present invention, the parts so named by including the word "window" in said names, are actually structural elements, wherein opaque material may be chosen in the fabrication of said parts in order to limit the transmission of light, or conversely, all structures referred to herein, may be fabricated from translucent material creating in effect a greenhouse type configuration. The designation of "window" is therefore arbitrary but shall serve as a common designation in this description.

Referring to FIG. 6A, the triangular part 90 is an interior window panel, and the profiled shape 91 will be folded to form a generally tetrahedron shaped exterior facing window part.

Referring to FIG. 6B, said tetrahedron shaped window part 91 is shown folded, wherein flaps 92 have been secured together to the inside of said tetra window part, and corner tabs 94 have been secured to window edge 95 on the outside of said tetra window part.

Referring to FIG. 7A, the interior facing plane view of a structural panel is shown, wherein said window panel 90 and said folded tetrahedron window part 91 are ready to be conjoined to said structural panel.

Wherein said folded tetrahedron window 91 has "v" edges 95 which were formed as a result of folding said tetrahedron window part 91.

Whereby said tetrahedron window 91 is conjoined with said structural panel (FIG. 7B) by mating said "v" edges 95 with said saddle edges 96 (FIG. 7A), and by mating tabs 97 on said tetrahedron window part 91 with slots 51 on said structural panel unit.

Wherein the conjoining of said tetrahedron window 91 and said structural panel creates a compression force along the juncture between said "v" edges 95 and said saddle edges 96, wherein said compression force serves to lock said window part 91 into place with said structural panel thereby increasing structural strength to both said window part 91 and said structural panel.

Referring to FIG. 7B, said tetrahedron window 91 has been conjoined with said structural panel unit, and said interior window panel 90 is arranged and ready to be conjoined to said structural panel unit.

Wherein inner window 90 is conjoined to said structural panel by mating inner window panel tabs 98 to the inner window mounting slots 89 on said structural panel unit (FIG. 7B).

Referring to FIG. 7C, an interior facing plane view of said structural panel unit with said window parts 90 and 91 installed is shown.

Airflow

One important benefit of constructing a space enclosing structure from substantially hollow structural panels is that the said space enclosing structure will effectively have a concentric shell configuration. That is, an inner, and an outer shell having a substantial void formed between. A concentric shell configuration allows the utilization of any convective airflow within said void to be harnessed for practical ends.

Air is allowed to flow throughout each substantially hollow structural panel, and in between any conjoined structural panels which are forming a space enclosing structure by means of vents 20, 21, 22.

Referring to FIG. 7D an exterior facing plane view of said structural panel unit with said window parts 90 and 91 installed is shown.

Wherein a hollow void is formed between said installed tetrahedron window part 91 and said inner window part 90.

Wherein said void formed between said window parts is connected with said hollow space inside said structural panel by means of vent holes 21 thereby allowing airflow to pass between said window void and said hollow panel space.

Wherein said airflow may flow into, or out of said hollow panel space by means of vents 20.

Wherein said airflow may circulate throughout said space enclosing structure by means of the combined function of said vents 20, 21, 22.

Conjoining Structural Panels

In order to construct a useful space enclosing structure, a plurality of structural panel units must be conjoined.

Referring to FIG. 8, two structural panels are aligned and ready for conjoining. Flaps 99, and additionally a tab and slot means are provided with each structural panel to produce an automatic alignment and locking action when said structural panels are conjoined.

One characteristic of a space enclosing structure formed from a plurality of said substantially hollow structural panels is the aforementioned concentric shell configuration, wherein said shell configuration consists an outer shell or skin, and an inner shell separated by a substantially hollow void. When flaps 99 are overlapping on said conjoining structural panels, a tension is produced across said skin of said space enclosing structure and a compression force is created between the edges said conjoined structural panels.

Wherein tabs 70 and 72 are inserted into slots 71 and 73, and flaps 99 overlap the exterior faces of each adjoining structural panel, and tab 76 is inserted into slots 77 and 78, thereby automatically placing into alignment and physically interlocked in all directions the two said structural panels.

Another novel characteristic granted by the present invention is the ability for conjoined structural panel units to be varied in their respective orientation across the longitudinal axis formed at the conjunction of said panels outer facing plane through an arc of at approximately 60 degrees without significantly affecting the combined structural strength of said conjoined panels.

This variability in said angle across said panels outer facing planes allows both pentagonal and hexagonal assemblies to be formed from said conjoined structural panels wherein said hexagonal and pentagonal assemblies may be utilized in the construction of space enclosing structures without necessitating additionally sized or shaped discreet structural panels or panel parts.

Referring to FIG. 9A, two conjoined structural panels configured to form an angle of 180 degrees across the contiguous exterior facing planes are shown.

Referring to FIG. 9B, two conjoined structural panels configured to form an angle of 138.19 degrees across the contiguous exterior facing planes is shown.

Space Enclosing Structure

A novel characteristic of the present invention is the ability to construct a variety of differently shaped space enclosing structures utilizing only one structural panel type.

Whereby altering the quantity of similar structural panel units being conjoined together, and varying the angle across the exterior facing planes of said panels, a space enclosing structure of a desired shape may be achieved.

Referring to FIG. 10, an exterior perspective of a space enclosing structure shaped in the manner of a partial 1 frequency icosahedron utilizing fifteen conjoined structural panels is shown.

Referring to FIG. 11, an exterior perspective of a space enclosing structure utilizing forty conjoined structural panels is shown.

Referring to FIG. 12, an exterior perspective of a space enclosing structure utilizing thirty conjoined structural panels is shown.

Referring to FIG. 13, an exterior perspective of a space enclosing structure utilizing thirty conjoined structural panels is shown.

While in the foregoing specification detailed descriptions of specific embodiments of the invention have been set forth for the purpose of illustration, it is to be understood that many of the details herein given may be varied considerably by those skilled in the art without departing from the spirit and scope of the invention.

I claim:

1. A modular structural panel unit for construction of a space-enclosing or area-covering structure comprising: a plurality of substantially similar profiled sheets of flat, rigid, foldable material, wherein:

(a) each said sheet of material has a series of longitudinal fold lines spaced from, and substantially parallel to, each other to form a first hollow box-like beam structure of polygonal cross section having at least two substantially parallel walls that are spaced from each other when folded along said lines and one of said walls forms an outer surface;

(b) said box-like beam has opposed end face, planes mitered at angles appropriate to the number of sides of said structural panel unit;

(c) one mitered end of said first box-like beam is substantially open and configured to overlap a corresponding opposite end of a second, substantially identical box-like beam structure, and the opposite mitered end of said first beam is substantially open and configured to engage a corresponding opposite end of a second, substantially identical box-like beam structure; and (d) a plurality of similar box-like beams are conjoined and interlocked by corresponding mating tabs and slots to form said structural panel unit.

2. A modular structural panel unit as in claim 1 wherein:

(a) said box-like beam includes a substantial flap which extends sideways from the outside edge of an exterior face plane of said beam;

(b) said flap is contiguous with a perimeter edge of the exterior face of said structural panel unit; and (c) said flaps are configured to overlap and interlock with the exterior face of at least one conjoined similar structural panel unit in a symmetrical orientation.

3. A modular structural building panel unit as in claim 1 wherein:

(a) each of said box-like beams forming said panel includes a plurality of ventilation apertures; and (b) said ventilation apertures are aligned in said panel to allow for air flow throughout the hollow space inside said beams conjoined to form said panel and between adjacent conjoined similar panel units.

4. A modular structural panel unit as in claim 1 which includes a window member formed from at least one folded panel, and wherein:

(a) said window member is attachable to a structural panel over an aperture generally central to said panel and framed by said beams that are conjoined to form said panel;

(b) said window is configured in a shape that is generally congruent to the perimeter of said aperture; and (c) said window member engages said beams forming said panel both in compression and in tension to contribute structural strength to said structural panel.

5. A structural beam element of a space-enclosing or area-covering structure wherein a plurality of substantially identical beam elements are assembled into polygonal structural panel units and said structural panel units are in turn interlockingly assembled to form said structure without requiring a supporting framework, comprising:

a) a beam element blank that includes:

i) a generally L-shaped foldable sheet of rigid, self-supporting material having a length along a longitudinal axis greater than its width normal to said axis forming a stem portion of said L shape, a foot portion projecting laterally from one side of said stem portion and extending from one end of said stem portion a factional part of the length of said stem portion, and a polygonal flap extending longitudinally from the foot portion and laterally from the foot end of the stem portion;

ii) opposite ends of said stem portion are mitered at angles appropriate to the number of sides of said polygonal structural panel unit;

iii) first and second spaced fold lines oriented parallel to said longitudinal axis And disposed medially in said stem portion and extending the length (hereof from end to end, said fold lines defining a first peripheral edge face and a first, outer face and a second, inner face contiguous with each of said respective fold lines, said sheet being foldable along said medial fold lines to form a generally U-shaped cross section with said outer and inner faces being spaced from and generally parallel to each other by said peripheral edge face;

iv) foldable slotted flap and tab portions formed in outer marginal edges of said inner and outer faces that can be interlocked to form a second edge face; and v) said faces together forming a hollow beam in cross section with said foot and said polygonal flap extending outwardly from a portion of one side margin that is adjacent an end margin of said outer face; and b) said stem, foot and polygonal flap include mating slots and tabs so that a plurality of said beam elements formed from substantially identical folded blanks can be joined and interlocked to form a polygonal structural panel unit with said polygonal flaps extending outwardly from an outer periphery marginal edges thereof, and in turn a plurality of structural panel units can be interlockingly joined by said extending tab-carrying polygonal flaps to form a space-enclosing or area-covering structure.

6. A structural beam element as in claim 5 wherein: least one end of said stem portion is mitered so that the assembled structural panel unit is substantially triangular.

7. A structural beam element as in claim 6 wherein the lateral and longitudinal dimensions of said beam blank are selected to provide, upon folding and interlocking with a plurality of substantially identical beam elements, a substantially centrally located aperture for a window member.

8. A structural beam element as in claim 7 wherein said beam element slotted flap and tab portions interlock to form a second, central edge face generally parallel to said first peripheral edge face, and said central edge face includes slots that matingly engage tabs of a window member that covers said centrally located aperture.

9. A structural beam element as in claim 8, which is configured to interlockingly engage a window member selected from material that is opaque, translucent or transparent and configured to be at least one of substantially planar or substantially pyramidal in form.

10. A structural beam element as in claim 8, wherein the end of the stem portion opposite the foot is closed with a folded panel that interlocks with at least one of the inner and the outer faces, the polygonal flap is generally triangular and the structural panel units are constructed from three such substantially identical beam elements with a substantially triangular periphery.

11. A structural beam element as in claim 8 wherein said first edge face is disposed at an acute angle to at least one of the adjacent inner or outer face to permit angular flexibility between adjacent structural panel units assembled from a plurality of substantially identical beam elements so that the structural panel units can be assembled into a wide range of space-enclosing or area-covering structures having from 2 to about 40 faces.

12. A structural beam element as in claim 11 wherein the acute angle is defined between the outer periphery marginal edge face and the outer panel face.

13. A structural beam element as in claim 12 wherein the lateral and longitudinal dimensions of said beam blank are selected to provide, upon folding and interlocking with a plurality of substantially identical beam elements, a substantially centrally located aperture for a window member bounded by a second central edge face, and both said first and second edge faces are oriented at an acute angel to said outer face so that said beam is substantially trapezoidal in cross section.

14. A structural beam element as in claim 5 wherein said edge faces include apertures to permit air flow between the internal hollow spaces in adjacent beam elements, and when assembled as structural panel units, to permit air flow between the hollow spaces in adjacent structural panel units.

15. A structural beam element as in claim 14 wherein said apertures in said second edge face permit air flow between a window member and the hollow spaces in adjacent beam elements that form a frame for said window member.

16. A structural panel unit for a structure comprising:

a) rigid, self supporting sheet material folded to form a generally L-shaped hollow beam, polygonal in cross section, having at least two generally parallel, spaced-apart planar faces, defining respectively, an inner face and an outer-face, said L shape including a longitudinally extending stem portion and a coplanar extension from one of said faces adjacent one end of said stem to form a foot portion of said L, said L being enclosed by edge walls on at least two opposite sides of said longitudinal stem portions both said foot and said end of said L adjacent thereto being open, and including a polygonal flap portion coplanar to said foot portion and extending from a bottom edge of said foot and said stem portion adjacent said foot;

b) said stem and foot include slots and tabs that mate with corresponding tabs and slots in substantially identical structural elements so that a plurality of said elements can be conjoined to form a polygonal structural panel unit having said polygonal flap portions extending outwardly from the margins of said structural panel unit; and c) said structural panel unit is configured to interlock with a plurality of polygonal flaps of substantially identical structural panel unit to form a space-enclosing or area-covering structure without supporting framework, said structure having concentric, spaced inner and outer shells.

17. A structural panel unit as in claim 16 wherein said structural panel unit is generally triangular, the space between said inner and outer faces includes insulation, said edge walls include apertures to permit air circulation between adjacent structural panel units, and said sheet material is weather resistant.

18. A structural panel unit as in claim 17 wherein said sheet material is selected from materials containing plastic, cardboard, wood and composites.

19. A space-enclosing or area-covering structure comprising:

a) a plurality of hollow, structural polygonal structural panel units constructed of rigid, self-supporting sheet material, including an inner shell face spaced from an outer shell face, and said faces are spaced from each other adjoined along a plurality of edge panels to form a hollow structural member;

b) said structural panel units include a plurality of interlocking flaps that extend from and are substantially co-planar with at least one of said inner shell and said outer shell faces, said interlocking flaps are spaced along the periphery of said structural panel unit; and c) each said structural panel unit is joined to at least one substantially similar adjacent structural panel unit by said interlocking flaps engaging said adjacent structural panel unit to form a self supporting structure without requiring a supporting framework to which the structural panel units are fastened.

20. A space-enclosing or area-covering structure as in claim 19 wherein said structural panel units are substantially triangular in peripheral configuration, a plurality of said triangular structural panel units are assembled to form, generally, a dome structure selected from at least a part of an icosahedron, a dodecahedrion and a geometric shape having up to about 40 faces.

21. A space-enclosing or area-covering dome-type structure as in claim 20 wherein a plurality of said partial dome structures are disposed adjacent each other, said domes are linked with connecting covered passageways, and said domes include an entry provided in at least one structural panel unit at ground level.

22. A space-enclosing or area-covering dome type structure as in claim 20 wherein a plurality of structural panel units adjacent the ground level are omitted to provide a shade structure.

23. A space-enclosing or area-covering dome type structure as in claim 20 wherein the space between said inner and outer shells includes insulation, said edge panels include apertures to permit air circulation between the hollow spaces in adjacent structural panel units, and said sheet material is weather resistant.

24. A space-enclosing or area-covering dome-type structure as in claim 21 wherein said sheet material is selected from materials containing plastic, cardboard, wood and composites.

25. A space-enclosing or area-covering structure as in claim 16 wherein said structural panel unit is generally triangular, the space between said inner and outer faces includes insulation, said edge walls include apertures to permit air circulation between the hollow spaces in adjacent structural panel units, and said sheet material is weather resistant.

26. A blank of rigid, self-supporting sheet material foldable along a plurality of generally parallel, spaced lines to create a hollow box beam element consisting essentially of open mitered ends that is generally trapezoidal in cross section, and which includes mating slots and tabs for interlocking with identical beam elements to form a regular, polygonal self-supporting structural panel unit, each said box beam element having a planar polygonal tab as an extension of one beam surface for interlocking with a plurality of identical regular polygonal structural panel units placed in peripheral edge alignment to form a self-supporting, frameless, structure having concentric, spaced, outer and inner surfaces joined at the edges of said structural panel units by bean side walls thereof.

27. A structural bean element as in claim 15 wherein said window member includes an outer window layer and an inner layer spaced therefrom and the apertures in said beam elements permit air to circulate into the space between said inner and outer window layers.

28. A structural beam element as in claim 11 wherein the space in said beam elements includes insulation, said edge walls include apertures to permit air circulation between hollow spaces in adjacent structural panel units, said sheet material is weather resistant and selected from materials containing plastic, cardboard, wood and composites.

* * * * *